US005575956A

United States Patent [19]

Hermansen et al.

[11] Patent Number: 5,575,956

[45] Date of Patent: Nov. 19, 1996

[54] ROOM-TEMPERATURE STABLE, ONE-COMPONENT, ELECTRICALLY-CONDUCTIVE, FLEXIBLE EPOXY ADHESIVES

[75] Inventors: Ralph D. Hermansen, Northridge; Steven E. Lau, Los Angeles, both of Calif.

[73] Assignee: Hughes Aircraft Company, Los Angeles, Calif.

[21] Appl. No.: 504,002

[22] Filed: Jul. 19, 1995

[51] Int. Cl.[6] ..... H01B 1/22

[52] U.S. Cl. ..... 252/514; 252/512

[58] Field of Search ..... 252/512, 514; 525/423; 523/400

[56] References Cited

U.S. PATENT DOCUMENTS

| | | | |
|---|---|---|---|
| 3,910,852 | 10/1975 | Lederman et al. | 252/512 |
| 3,983,075 | 9/1976 | Marshall et al. | 252/512 X |
| 4,557,860 | 12/1985 | DiSalvo et al. | 252/514 X |
| 4,574,056 | 3/1986 | Kimura | 252/514 |
| 4,692,272 | 9/1987 | Goswani et al. | 252/514 |
| 4,696,764 | 9/1987 | Yamazaki | 252/514 X |
| 4,866,108 | 9/1989 | Vachon et al. | 523/428 |
| 4,940,633 | 7/1990 | Hermansen et al. | 428/324 |
| 5,061,776 | 10/1991 | Weaver et al. | 528/60 |
| 5,156,771 | 10/1992 | Yamamoto et al. | 252/514 X |
| 5,457,165 | 10/1995 | Hermansen et al. | 525/420.5 |

*Primary Examiner*—Douglas J. McGinty
*Attorney, Agent, or Firm*—M. E. Lachman; M. W. Sales; W. K. Denson-Low

[57] ABSTRACT

A flexible electrically-conductive epoxy-based adhesive composition and method for making the same are provided. The present adhesive composition comprises: (a) a polymer mixture comprising at least one polyepoxide resin having a hardness not exceeding a durometer Shore A reading of 45, when cured with a stoichiometric amount of diethylene triamine ("DETA"), and a substantially stoichiometric amount of at least one latent epoxy resin curing agent; and (b) an electrically-conductive filler comprising a metal. Optional components include secondary epoxy resins, non-reactive flexibilizers, diluents, and processing aids. The present adhesive composition is rheologically stable for weeks as a single component mixture at room temperature and is curable in less than two hours at a temperature ranging from about 100° C. to 140° C., whereupon the cured adhesive composition exhibits a durometer Shore A of less than 95 and a volume resistivity less than about $10^{-2}$ ohm-cm at room temperature.

12 Claims, No Drawings

ROOM-TEMPERATURE STABLE, ONE-COMPONENT, ELECTRICALLY-CONDUCTIVE, FLEXIBLE EPOXY ADHESIVES

CROSS-REFERENCE TO RELATED APPLICATIONS

The present application is related to applications having Ser. Nos. 08/504/168 and 08/504,105, both filed on even date herewith and respectively entitled "Room-Temperature Stable, One-Component, Thermally-Conductive, Flexible Epoxy Adhesives" and "Room-Temperature Stable, One-Component, Flexible Epoxy Adhesives".

TECHNICAL FIELD

The present invention relates generally to compositions used as adhesives. More particularly, the present invention relates to flexible epoxy compositions for use as electrically-conductive adhesives, which are designed to be stable at room temperature.

BACKGROUND ART

The flexible polymer market offers a wide variety of adhesive polymers, including such compounds as polyurethanes, polysulfides, silicones, and epoxy compounds. In particular, epoxy compounds demonstrate the ability to strongly adhere to a variety of materials, including metal, glass, plastic, wood, and fiber, and consequently are often used to bond dissimilar materials. Further, epoxy compounds are known to exhibit excellent resistance to attack by many corrosive chemicals. Despite their abilities to bond dissimilar materials and resist chemical attack, commercially-available epoxy compounds lack certain properties necessary for use as electrically-conductive adhesives in automated bonding processes. More particularly, an epoxy-based, electrically-conductive adhesive must also be convenient to store and readily curable to form sufficiently flexible bonds. Presently, electrically-conductive epoxy-based adhesives are available in two forms, namely two-component systems or one-component systems, neither of which is both convenient to store and readily curable.

Two-component epoxy-based adhesives are readily curable at room temperature but are inconvenient to use and store. The components of two-component systems must be accurately measured and properly mixed just prior to use. Thus, the various components to be mixed must be separately stored until use, and production workers are charged with the added responsibility of preparing epoxy-based adhesives having uniform properties. Not surprisingly, two-component epoxy-based adhesives are not favored.

One-component epoxy-based adhesives are available for industrial application in two basic forms: rigid epoxy adhesives and frozen pre-mix, flexible epoxy adhesives. While such adhesive compositions are conveniently stored as a single component, they require curing at elevated temperatures. Rigid epoxy adhesives include such compounds as Bisphenol-A epoxy adhesives and novolacs. These rigid epoxy adhesives exhibit strong adhesion for many materials and may be conveniently stored at room temperature. However, rigid epoxy-based adhesives form brittle bonds that are often insufficiently pliant for bonding dissimilar materials. For example, a brittle bond between dissimilar materials with different thermal expansion rates may be unable to withstand the stresses caused by the thermal mismatch, so that both the bond and its adherends may be susceptible to failure.

Frozen pre-mix, flexible epoxy adhesives are also employed by industry, although the usage of such adhesives is far surpassed by the usage of rigid epoxy adhesives. A description of frozen pre-mix, flexible epoxy adhesives is found in U.S. Pat. No. 4,866,108, assigned to the present assignee, which discloses and claims the composition behind Flexipoxy 100 Adhesive, a frozen flexible epoxy adhesive developed for spacecraft electronic applications. In comparison to rigid epoxy adhesives, flexible epoxy adhesives form more pliable bonds that are capable of successfully adapting to stresses between dissimilar materials caused by differing rates of expansion. However, in contrast to rigid epoxy adhesives, frozen pre-mix flexible epoxy adhesives must be stored in a frozen state and must be thawed prior to use. Moreover, frozen adhesives offer a limited working life of only about 2 to 8 hours once thawed, whereas at least one week of working life is realistically required for general automated bonding operations. Therefore, frozen pre-mix, flexible epoxy adhesives are widely considered impractical for use in high volume automated processing given the scheduling difficulties wrought by both the need to thaw the adhesives as well as the limited working life available after thawing.

Thus, a need remains for a one-component electrically-conductive epoxy adhesive that offers the convenience of room temperature storage and low temperature, rapid curing while also providing pliable bonds capable of withstanding the rigors of varying expansion rates between bonded materials. This need is particularly acute for high volume automated bonding operations, which can tolerate neither frequent periods of downtime for thawing nor the expense of discarding adhesives that quickly become ineffective. This need must be achieved without sacrificing good adhesion characteristics.

DISCLOSURE OF INVENTION

In accordance with the present invention, epoxy adhesive compositions are provided which are electrically-conductive, storable at room temperature, produce non-brittle, flexible bonds, exhibit strong adhesion, and have good processing characteristics. Further, the present compositions may be readily cured at relatively low temperatures (ranging from about 100° C. to 140° C.) in less than two hours. Accordingly, these compositions possess most, if not all, of the advantages of the above prior art compositions while overcoming their above-mentioned significant disadvantages.

The room-temperature stable, one-component, flexible epoxy-based adhesive compositions of the present invention comprise:

(a) a polymer mixture comprising
  (i) at least one polyepoxide resin having a hardness not exceeding a durometer Shore D reading of 45 when cured with a stoichiometric amount of diethylene triamine ("DETA"), and
  (ii) a substantially stoichiometric amount of at least one latent epoxy resin curing agent; and (b) an electrically-conductive filler comprising a metal, wherein the adhesive composition, upon cure, exhibits a volume resistivity less than about $10^{-2}$ ohm-cm and a durometer Shore A of less than about 95.

The polyepoxide resin component of the present compositions is a flexible epoxy resin. Flexible epoxy resins are defined herein to be those epoxy resins having a durometer Shore D measurement of 45 or less when cured with DETA. In comparison, semi-flexible epoxy resins are defined to be those epoxy resins having a durometer Shore D value ranging from about 45 to 75 when cured with DETA and rigid epoxy resins are defined as epoxy resins having a Shore D value exceeding about 75 when cured with DETA.

The epoxy resin curing agent employed to cure the epoxy resin is a latent curative. As such, there is no reaction between the curing agent and the epoxy resin component at room temperature. Rather, the epoxy resin component is cured in the presence of the curing agent upon exposure to elevated temperatures. The present combination of epoxy resin, latent epoxy resin curing agent, and filler remains uncured and rheologically stable at room temperature for weeks or even months, thus providing a long storage life conducive to automated bonding operations.

The electrically-conductive filler is employed at a sufficient volume percent to allow the flow of electricity through the adhesive composition. More specifically, the filler must be present in sufficient quantities such that the filler particles are within Angstrom units of one another, thereby creating pathways for electrons to travel through the adhesive composition.

Aside from epoxy resin, latent curing agent, and filler components, other components that may be optionally added to the present adhesive compositions include diluents, flexibilizers, and processing additives such as antioxidants.

The selected recited epoxy resins and latent curing agents are fully compatible with each other and, upon cure and incorporation of a suitable filler, form flexible adhesives having a volume resistivity less than $10^{-2}$ ohm-cm at room temperature. Thus, the present adhesive formulations are both electrically conductive and sufficiently flexible to withstand the stresses of thermal mismatch.

The present adhesive compositions are prepared by first mixing the following components to form a thoroughly wetted mass: (1) liquid components comprising the epoxy resin component, and optionally, flexibilizers and diluents; and (2) solid components comprising the latent epoxy resin curing agent, the filler, and optionally, processing additives. The thoroughly wetted mass is then reacted at a temperature ranging from about 100° C. to 175° C. to form the present cured flexible epoxy adhesives, although the composition is designed to cure at a relatively low temperature ranging from about 100° C. to 140° C. in less than two hours.

In sum, the adhesive of the present invention is novel in providing an epoxy-based electrically-conductive composition that is rheologically stable for weeks or even months as a single component mixture at room temperature, curable at low temperatures (ranging from about 100° to 140° C.) in less than two hours, and flexible upon curing to temperatures as low as −50° C. Thus, the present adhesives offer the best features of the prior art adhesives. Like the frozen, pre-mix, flexible epoxy adhesives, the present adhesives form pliant bonds that withstand the stresses of thermal mismatch. Like the rigid epoxy adhesives, the present compositions may be conveniently stored at room temperature and easily processed. The ability of the present adhesives to provide strong, flexible, electrically-conductive bonds without wreaking havoc on production schedules effectively promotes epoxy-based adhesives to use in automated bonding processes. In short, these adhesives enable industry to avail itself of the excellent adhesive qualities associated with epoxy compounds without sacrificing the advantages of automation. Importantly, the compositions of the present invention offer these benefits without employing solvent components, so that environmental integrity is maintained.

DETAILED DESCRIPTION OF THE PREFERRED EMBODIMENTS

The adhesive compositions of the present invention have been developed to provide industry with the ability to store uncured epoxy-based adhesives at room temperature, as well as to provide a cured epoxy-based adhesive with good adhesion qualities, electrical conductivity, flexibility, and ease of processing. More particularly, the present adhesive compositions are curable in less than two hours at temperatures ranging from about 100° C. to 140° C. and, upon cure, exhibit a volume resistivity less than about $10^{-2}$ ohm-cm at room temperature and a flexibility measured as less than about 95 Shore A durometer.

The compositions of the present invention are based on the use of a combination of selected epoxy resins, a curing agent, and a filler which will provide a flexible, electrically-conductive product that is storable at room temperature in an uncured state. The selection of the particular epoxy resins and the curing agent is critical in obtaining the desired flexibility in the final adhesive product.

The compositions of the present invention employ at least one polyepoxide resin falling within the class of so-called "flexible epoxy resins". The phrase "flexible epoxy resin" is intended to encompass epoxy resins having a durometer Shore D reading not exceeding 45 when cured with diethylene triamine ("DETA"). The internal flexibility exhibited by suitably flexible polyepoxide resins derives from such features as long aliphatic chains, ether and ester linkages in the polymer chains, and double carbon-carbon bonds, which increase flexibility by enhancing the rotation of adjacent single carbon-carbon bonds.

The polyepoxide resin or blend of polyepoxide resins employed in the practice of the invention should have an epoxide equivalent weight exceeding about 250 so that the resin:curative volume ratio is maximized for reasons explained below. Polyepoxide resins having epoxide equivalent weight exceeding 250 that are suitably employed in the practice of the invention as primary resins include the following compounds: (1) the adduct of two moles of bis-phenol A with one mole of linoleic dimer acid, which has an epoxy equivalent weight of about 700 and is commercially available from the Shell Chemical Company, Houston, Tex., under the trade designation EPON 872; (2) the trifunctional novolac epoxy of cardanol having an epoxy equivalent weight of about 600, as available from the Cardolite Corp., Newark, N.J., under the trade designation NC-547; (3) the difunctional epoxy of cardanol having an epoxy equivalent weight of about 350, as available from Cardolite Corp. under the trade designation NC-514; (4) the diglycidyl ether of polyoxypropylene glycol having an epoxy equivalent weight of about 320, as commercially available from Dow Chemical, Midland, Michigan, under the trade designation DER 732; (5) the diepoxide of a polyoxypropylene diol, which has an epoxy equivalent weight ranging from about 290 to 325 and is commercially available from Shell Chemical Co. under the trade designation Heloxy 502; and (6) the polyglycidyl ether of an aliphatic polyol, which has an epoxy equivalent weight of about 650 and is commercially available from. Shell Chemical Co. under the trade designation Heloxy 84.

While flexible polyepoxide resins having epoxide equivalent weights less than about 250 are not suitably employed as a primary resin, they may be employed as secondary resins so long as the average epoxide equivalent weight of the mixture of the polyepoxide resins exceeds about 250. Secondary resins are used to enhance certain properties of the adhesive composition, such as flexibility and lap shear strength. Examples of secondary resins that may be employed as secondary resins include the following compounds: (1) the diglycidyl ether of 1,4-butanediol, which has an epoxy equivalent weight of about 130 and is available from Shell Chemical Co. of Houston, Tex. under the trade designation Heloxy 67; (2) the diglycidyl ether of neopentyl glycol, which has an epoxy equivalent weight of about 135 and is available from Shell Chemical Co. under the trade designation Heloxy 68; (3) the diglycidyl ether of cyclohexane dimethanol, which has an epoxy equivalent weight of about 160 and is available from Shell Chemical Co. under the trade designation Heloxy 107; and (4) the diglycidyl ether of polyoxypropylene glycol, which has an epoxy equivalent weight of about 190 and is commercially available from Dow Chemical, Midland, Mich., under the trade designation DER 736. The maximum allowable concentration of secondary resin will vary according to the composition of the adhesive; however, as a general rule, the amount of secondary resin present in the adhesive composition preferably does not exceed 40 wt % of the polyepoxide resin component It is important to note that not all so-called flexible polyepoxide resins having equivalent epoxy weights exceeding 250 are suitable for the practice of the invention. For instance, certain flexible epoxy resins fail to cure in a reasonable amount of time with available latent epoxy resin curatives. One example is the polyglycidyl ether of castor oil, which has an epoxy equivalent weight of about 600 and is commercially available from Shell Chemical Co. of Houston, Tex., under the trade designation Heloxy 505. However, Heloxy 505 may be employed as a secondary resin to enhance the flexibility of the adhesive composition.

The curing agents used in the present compositions are chosen to provide a flexible product from the selected epoxy resins. The present curing agents are characterized by long aliphatic moieties in their structure which allow compatibility with the selected resins at cure temperature. The present curing agents are further characterized as "latent" curatives. A latent curative is one that does not operate to cure an epoxy resin until melted in the elevated temperatures of a curing process while in contact with the targeted epoxy resin. Additionally, curing agents preferably employed in the practice of the invention should have two or more active hydrogen atoms per molecule, have a melting point or softening point between about 60° C. and 150° C., and should be available as finely-divided powders.

Examples of curing agents that may be suitably employed in the practice of the invention to achieve flexible epoxy adhesives (in view of the selected classes of epoxy resins, the selected cure temperature ranging from about 100° C. to 140° C., and the selected cure time of less than two hours) include dihydrazide curing agents. Examples of dihydrazide curing agents suitably employed in the practice of the invention include the following compounds available from Ajinomoto Co., Inc., of Teaneck, N.J.:

(1) aliphatic dihydrazide with Diuron accelerator (3-(3,4-dichlorophenyl)-1,1-dimethyl urea), having an active hydrogen equivalent weight of 134 as available under the trade designations Ajicure AH- 122 and Ajicure AH-123;

(2) adipic acid dihydrazide with Diuron accelerator (3-(3,4-dichlorophenyl)-1,1-dimethyl urea), having an active hydrogen equivalent weight of 49 as available under the trade designation Ajicure AH-127;

(3) icosanedioic acid dihydrazide ($C_{20}H_{42}N_4O_2$), having an active hydrogen equivalent weight of 92.5 as available under the trade designation LDH, with about 10% of the compound as sold being hexadecanedioic acid dihydrazide according to the Ajinomoto material safety data sheet ("MSDS");

(4) 7, 11-octadecadiene-1,18-dicarboxylic acid dihydrazide ($C_{20}H_{38}N_4O_2$), having an active hydrogen equivalent weight of 91.5 as available under the trade designation UDH; and (5) Valine dihydrazide, having an active hydrogen equivalent weight of 78.5 as available under the trade designation of VDH.

Preferably, AH-122 and AH-127 are employed in the practice of the present invention.

Additionally, there are certain latent curing agents that, while incapable of inducing a cure at 100° C. in one hour, may be employed with the proviso that a cure temperature and cure time at the upper end of the recited ranges be employed. Namely, the polyamine adduct of epoxy resin (as commercially available from Air Products, Allentown, Pa., under the trade designation Antamine 2014), and epoxy-amine adducts (for example, as commercially available from Ajinomoto Co., Inc. under the trade designations Ajicure PN-23) may be suitably employed at cure temperatures in excess of 120° C. and at cure times approximating two hours.

The amount of latent curing agent is preferably in stoichiometric proportion relative to the epoxy resin employed. In general, the amount of curing agent may be varied about ±15 percent from stoichiometry, with little adverse effect on the final product. The severity of adverse affects deriving from employing more or less than the exact stoichiometric amount of curing agent depends upon the functionality of the ingredients employed (e.g., trifunctional epoxy resins fare better than difunctional epoxy resins) and the cure temperatures employed (e.g., resins cured at higher temperatures fare better than those cured at lower temperatures).

The latent epoxy curing agents employed in the present compositions are commercially available as solid powders. Given that other components such as the filler are also in particulate form and that the liquid content of the adhesive composition is limited to holding a finite volume of solid particles, the volume of the particulate curing agent should be minimized so that other particulate components have adequate space within the adhesive composition to serve their intended functions. As such, it is preferable that the resin:curative volume ratio be maximized to allow the fillers and other solid components to perform their intended functions at optimally minimal concentrations. The epoxy resins and curing agents selected for use in the practice of the present invention reflect an attempt to maximize the resin:curative volume ratio whereby the epoxy resins have as high an epoxy equivalent weight as possible while the curing agents have as low an equivalent weight as possible. Thus, the present adhesive compositions maximize the resin:curative volume ratio while maintaining substantially stoichiometric proportions.

The filler component serves to render the present adhesive compositions electrically conductive. To achieve electrical conductivity, the filler must be incorporated to such an extent that the filler particles are within a few Angstrom units from one another, thereby forming pathways for electron travel. Until the filler concentration reaches this critical level, the volume resistivity of the adhesive composition will remain high (e.g., $10^{12}$ ohm-cm) and its electrical conductivity will remain negligible. Once the critical filler concentration level is reached, the adhesive composition will exhibit a volume resistivity less than about $10^{-2}$ ohm-cm at room temperature. The critical filler concentration is generally reached at about 40 vol % of the total adhesive composition. Notably, the critical filler concentration is lower if fillers consisting of spherical particles are employed than if fillers consisting of particles having higher aspect ratios are employed, such as flakes and rods. Since different fillers have different densities, the critical weight percent for a particular filler will vary but may be calculated knowing the critical volume percent.

The electrically-conductive filler component may comprise any metal and may take such forms as metal powder, metal flakes, or non-metal particles having a metal outer coating. Preferably, a noble metal is employed to achieve longer term retention of electrical conductivity. Examples of noble metals suitably employed in the practice of the invention include gold, silver, and platinum. Examples of particles having a metal outer coating that are acceptable in the practice of the invention include silver-plated copper beads and silver-plated glass beads.

The particle size of the filler material should be considered in formulating the present adhesive compositions. As discussed regarding the selection of curing agents, the filler and curing agents are both solids and therefore compete for space within the adhesive composition. In addition to maximizing the resin:curative volume ratio, this potential overcrowding problem can also be overcome by selecting different particle sizes for curing agent and filler such that the smaller particle fits into the interstices between the larger particles.

Optionally, the composition of the present invention includes non-reactive flexibilizers, preferably not exceeding 50 wt % of the total liquids in the adhesive, which include the epoxy resins and the flexibilizers. In general, flexibilizers effectively increase the liquid content of the adhesive composition, thereby allowing greater addition of electrically-conductive filler to the adhesive composition so that reaching the critical filler concentration level is ensured. In particular, non-reactive flexibilizers act as external plasticizers which do not chemically attach to the polymer network but are retained in the network due to van der Waals attraction and/or hydrogen bonding. Consequently, they must have a chemical structure compatible with the epoxy/curative structure in order not to be expelled. Plasticizers with high molecular weight are desirable, since the increased chain entanglement between plasticizer and the epoxy/curative structure serves to decrease migration of the plasticizer. Simple experimentation to determine compatible plasticizers, such as by preparing a polymer and proposed plasticizer and observing whether compatibility exists, may be done. Such experimentation is considered to be a routine endeavor that is well within the capabilities of those having ordinary skill in the art and is not considered to be undue. Polyols having molecular weights of at least 1,000 and triols with molecular weights ranging from 1,500 to 6,000 are commonly employed as non-reactive plasticizers. Examples of high molecular weight triols suitably employed in the practice of the invention are high molecular weight poly(oxypropylene) triol (available from Union Carbide, Danbury, Conn., under the trade designation LHT-28) and hydroxyl-terminated polybutadiene (available from Atochem, under the trade designation Poly BD R45HT), with the latter being a flexibilizer of preference in the practice of the present invention. Other examples of suitable non-reactive flexibilizers include phthalate esters, adipate esters, and methyl lineolate.

The adhesive composition may also optionally include a diluent component. The diluent may comprise any monofunctional material (i.e., having one active hydrogen per molecule) that reduces viscosity. The diluent may comprise any of the well-known materials for this purpose, such as monoepoxides and secondary amines. Simple experimentation will readily determine the appropriate amount of diluent in the adhesive composition. The scope of experimentation required to determine the proper concentration of diluent is considered to be reasonable for those having ordinary skill in the art and is not considered to be undue.

Other optional additives to the flexible epoxy adhesive composition include UV stabilizers, antioxidants and various other processing aids such as wetting agents, anti-foaming agents, and dispersing agents, all of which are known and commonly used in the art. The processing aids are preferably employed at a concentration of up to 5 wt % of the total adhesive composition.

One novel feature of the invention is that the uncured combination of epoxy resins, latent curing agent, and filler is stable at room temperature. More specifically, the uncured combination is rheologically stable for weeks or even months at room temperature, meaning that it does not cure at room temperature and is stable in terms of viscosity. Thus, unlike frozen, pre-mix flexible epoxy compounds, the present compositions do not require thawing prior to curing and, as such, are available for curing on an as-needed basis. The combination is readily cured at temperatures ranging from about 100° to 140° C. in less than two hours. Upon cure, the present compositions remain flexible and reworkable, with a Durometer Shore A of less than 95. Another novel feature of the present composition is that its flexibility extends to as low as minus 50° C. (–50° C.), as measured by glass transition temperature $T_g$. This compares to typical glass transition temperatures in excess of +100° C. for rigid epoxy adhesives. Finally, the present adhesive compositions exhibit volume resistivities less than about $10^{-2}$ ohm-cm at room temperature. Thus, the present adhesive compositions provide flexible, strong bonds that serve to conduct electricity in electronic devices while being conducive to automated bonding operations by virtue of their room-temperature stability and ready curability.

The adhesive of the present invention is formulated by mixing the liquid components (namely, the epoxy resins, non-reactive flexibilizers, and diluents) with the dry ingredients (namely, the curing agents, fillers, and processing aids) in their appropriate concentrations until the dry ingredients are thoroughly wetted. Preferably, the dry ingredients are milled into the liquid ingredients, for example, using a 3-roll mill. Milling achieves a good blend of resin and curative so that the resulting adhesive is uniform in composition and therefore exhibits higher overall quality. Once the dry ingredients are thoroughly wetted, air is removed from the adhesive mixture by further mixing it under vacuum. The resulting uncured composition may be stored at room temperature for several weeks or even months.

When the mixture comprising the present composition is to be used as an adhesive, the mixture must be cured. First, the mixture is placed in contact with the materials to be bonded in the manner desired for adhesion. Then, the mixture is cured by heating both the materials to be bonded and the inserted mixture to an elevated cure temperature. While a cure temperature as high as 175° C. may be employed depending upon the particular electronics application, the present adhesive compositions are designed to cure at temperatures ranging from about 100° to 140° C. in a reasonable amount of time. While cure times vary with the melting point and molecular weight of the curing agent, the cure time for the adhesives of the present invention is designed to be less than two hours at the selected temperature range. It is contemplated that in most cases the cure time need only be approximately 30 minutes. Upon cure, the present adhesive composition forms a strong, flexible bond between the materials that remains flexible down to a glass transition temperature $T_g$ as low as −50° C., with the precise minimum $T_g$ depending on the formulation of the adhesive.

EXAMPLES

Examples 1–3 represent adhesive compositions prepared in accordance with the present invention, with the formulations of Examples 1–3 reported in Table I below. In each example, the polymer mixtures represent about 15 parts by weight (PBW) of the adhesive composition, while the filler represents about 85 PBW of the adhesive composition. The filler employed in each example was a silver flake powder that is commercially available from DuPont under the trade designation V9. The amount of filler employed represented about 35 vol % of the adhesive compositions.

The adhesive compositions of Examples 1–3 were formulated by mixing the liquid epoxy resins with the solid curing agents and fillers until the dry ingredients were thoroughly wetted and blended. In each case, the blended mixture was cured after exposure to a temperature of about 120° C.

Table I below lists various properties observed for the cured adhesive compositions of Examples 1–3. More particularly, the volume resistivity, glass transition temperature, durometer hardness values, and lap shear strength of each example are reported, with the lap shear strength being reported for cure times of both one hour and two hours. The volume resistivities were performed as specified by the American Society for Test and Materials ("ASTM") in ASTM D257. The glass transition temperature measurements were performed in accordance with ASTM E831. Shore-A and Shore-D Durometer tests were performed on the cured adhesive compositions as specified in "Indentation Hardness of Rubber and Plastics by Means of a Durometer" of ASTM D2240. Finally, tests for lap shear strength were performed as specified by ASTM D 1002.

For comparison, Examples 4–6 represent formulations outside the scope of the present invention. Each of these formulations failed to meet one or more requirements of the present invention, as illustrated in Table II.

TABLE I

TEST RESULTS WITHIN SCOPE OF INVENTION

| Example Number | Formulation | Volume Resistivity @ 23° C., ohm-cm | Glass Transition Temperature, °C. | Durometer Hardness | Lap Shear Strength, psi (kg/cm²)[1] One-hr. cure | Lap Shear Strength, psi (kg/cm²)[1] Two-hr. cure |
|---|---|---|---|---|---|---|
| 1 | 13.5 pbw Cardolite NC-547 resin<br>1.5 pbw Ajicure AH-127 curative<br>85 pbw silver flake powder | $5 \times 10^{-3}$ | −40 | 86 Shore A<br>50 Shore D | 160<br>(11) | 250<br>(17.5) |
| 2 | 11.1 pbw Cardolite NC-547 resin<br>2.7 pbw Heloxy 505 resin<br>1.2 pbw Ajicure AH-127 curative<br>85 pbw silver flake powder | $6 \times 10^{-3}$ | −35 | 82 Shore A<br>45 Shore D | 120<br>(8.5) | 180<br>(12.5) |
| 3 | 5.1 pbw Cardolite NC-547 resin<br>5.1 pbw Cardolite NC-514 resin<br>3.4 pbw Heloxy 505 resin<br>1.4 pbw Ajicure AH-127 curative<br>85 pbw silver flake powder | $1 \times 10^{-3}$ | −25 | 79 Shore A<br>38 Shore D | 140<br>(10) | 260<br>(18) |

[1]Aluminum-Aluminum

TABLE II

TEST RESULTS OUTSIDE SCOPE OF INVENTION

| Example Number | Formulation | Volume Resistivity @ 23° C., ohm-cm | Glass Transition Temperature, °C. | Durometer Hardness | Lap Shear Strength, psi (kg/cm²)[1] One-hr. cure | Lap Shear Strength, psi (kg/cm²)[1] Two-hr. cure |
|---|---|---|---|---|---|---|
| 4 | 22.5 pbw Cardolite NC-547 resin<br>2.5 pbw Ajicure AH-127 curative<br>75 pbw silver flake powder | $6 \times 10^{-1}$<br>Volume Resistivity Too High | −45 | 78 Shore A<br>35 Shore D | 180<br>(12.5) | 240<br>(17) |
| 5 | 2.7 pbw Cardolite NC-547 resin<br>11.1 pbw Heloxy 505 resin<br>1.2 pbw Ajicure AH-127 curative<br>85 pbw silver flake powder | $8 \times 10^{-3}$ | Not Available: Sample Did Not Cure within 4 hours at 120° C. | | | |
| 6 | 7.1 pbw DER 732<br>7.1 pbw Heloxy 67 resin<br>10.8 pbw Ajicure AH-122 curative<br>75 pbw silver flake powder | $4 \times 10^{-1}$<br>Volume Resistivity Too High | −25 | 77 Shore A<br>36 Shore D | 185<br>(10) | 190<br>(18) |

The formulations of Examples 1–3 performed in accordance with the invention. Their volume resistivities were each less than $10^{-2}$ ohm-era, their glass transition temperatures approached −50° C., their durometer hardness values were each less than 95 Shore A, and their lap shear strength values were sufficiently high to serve as adhesives.

In comparison, the formulations of Examples 4–6 failed to meet at least one of the objectives of the present invention. The formulation of Example 4 exhibited a volume resistivity in excess of $10^{-2}$ ohm-cm deriving from too little silver flake filler. The adhesive formulation of Example 5 did not cure in less than two hours at 120° C. due to its improper elevation of Heloxy 505 resin from a secondary resin to a primary resin. The adhesive formulation of Example 6 exhibited a volume resistivity in excess of $10^{-2}$ ohm-cm deriving from the use of too little filler, although more silver could not be added to effect a reduction in volume resistivity because of the high level of solid curative employed.

Thus, it has been demonstrated that adhesive compositions formulated in accordance with the present invention are electrically-conductive, curable at relatively low temperatures (ranging from about 100° to 140° C.) in less than two hours, and flexible upon curing, having a durometer Shore A of less than 95 at room temperature and glass transition temperatures approaching −50° C. Furthermore, the present adhesive compositions exhibit the lap shear strength necessary to provide sufficiently strong bonds in an industrial setting.

INDUSTRIAL APPLICABILITY

The cured adhesives of the invention are electrically-conductive while being flexible across wide ranges of temperatures. Further, the uncured adhesives of the invention are rheologically stable at room temperature for time periods measured in months. Given these qualities, the electrically-conductive adhesives of the invention may be successfully employed in numerous industrial applications requiring automated bonding of dissimilar materials, including the manufacture of such products as automobiles, motorhomes, aircraft, boats, and manufactured homes.

Thus, there has been disclosed a composition and a method for making an electrically-conductive, flexible epoxy adhesive that is storable in its uncured state at room temperature. It will be readily apparent to those of ordinary skill in this art that various changes and modifications of an obvious nature may be made, and all such changes and modifications are considered to fall within the scope of the invention, as defined by the appended claims.

What is claimed is:

1. A flexible electrically-conductive epoxy adhesive composition comprising a combination of the following components:

(a) a polymer mixture comprising (i) at least one flexible polyepoxide resin selected from the group consisting of the adduct of two moles of bis-phenol-A with one mole of linoleic dimer acid, the trifunctional novolac epoxy of cardanol, the difunctional epoxy of cardanol, the diglycidyl ether of polyoxypropylene glycol, the diepoxide of a polyoxypropylene diol, and the polyglycidyl ether of an aliphatic polyol, and (ii) a substantially stoichiometric amount of at least one latent epoxy resin curing agent selected from the group consisting of aliphatic dihydrazide, adipic acid dihydrazide, icosanedioic acid dihydrazide, 7,11-octadecadiene-1,18-dicarboxylic acid dihydrazide, valine dihydrazide, the polyamine adduct of epoxy resin, and epoxy-amine adducts, wherein said aliphatic dihydrazide and said adipic acid dihydrazide optionally further comprise an accelerator; and (b) an electrically-conductive filler comprising a metal, present in the amount of at least about 40 volume percent of said composition wherein said electrically-conductive epoxy adhesive composition is rheologically stable at room temperature, cures at about 100°–140° C., and, upon cure, exhibits a durometer Shore A of less than about 95 and a volume resisitivity of less than about $10^{-2}$ ohm-cm at room temperature.

2. A method for preparing a flexible electrically-conductive epoxy adhesive composition comprising the steps of:

(a) mixing the following components to form a thoroughly wetted mass:

(i) liquid components comprising at least one flexible polyepoxide resin, selected from the group consisting of the adduct of two moles of bis-phenol-A with one mole of linoleic dimer acid, the trifunctional novolac epoxy of cardanol, the difunctional epoxy of cardanol, the diglycidyl ether of polyoxypropylene glycol, the diepoxide of a polyoxypropylene diol, and the polyglycidyl ether of an aliphatic polyol, and optionally, at least one component selected from the group consisting of non-reactive flexibilizers and diluents, and (ii) solid components comprising a substantially stoichiometric amount of at least one latent epoxy resin curing agent selected from the group consisting of aliphatic dihydrazide, adipic acid dihydrazide, icosanedioic acid dihydrazide, 7, 11 -octadecadiene-1,18-dicarboxylic acid dihydrazide, valine dihydrazide the polyamine adduct of epoxy resin, and epoxy-amine adducts, wherein said aliphatic dihydrazide and said adipic acid dihydrazide optionally further comprise an accelerator, an electrically-conductive filler comprising a metal and being present in the amount of at least about 40 volume percent of said composition, and, optionally, processing aids, wherein said thoroughly wetted mass is rheologically stable at room temperature; and (b) reacting said thoroughly wetted mass at a temperature ranging from about 100° C. to 175° C. to form a cured flexible electrically-conductive epoxy adhesive composition, said cured flexible electrically-conductive epoxy adhesive composition having a Durometer Shore A of less than about 95 and a volume resistivity less than about $10^{-2}$ ohm-cm at room temperature.

3. The method of claim 2 wherein said electrically-conductive filler comprises a noble metal selected from the group consisting of silver, gold, and platinum.

4. The method of claim 3 wherein said electrically-conductive filler comprises silver flakes.

5. The flexible electrically-conductive epoxy adhesive composition of claim 1 wherein said electrically-conductive filler comprises a noble metal selected from the group consisting of silver, gold, and platinum.

6. The flexible electrically-conductive epoxy adhesive composition of claim 5 wherein said electrically-conductive filler comprises silver flakes.

7. The method of claim 2 wherein said non-reactive flexibilizer is selected from the group consisting polyols cwith molecular weights of at least 1,000 and triols with molecular weights ranging from 1,500 to 6,000 and said diluent is selected from the group consisting of monoepoxides and secondary amines.

8. The flexible electrically-conductive epoxy adhesive composition of claim 1 wherein said polymer mixture further comprises at least one secondary epoxy resin selected from the group consisting of the diglycidyl ether of 1,4-butanediol, the diglycidyl ether of neopentyl glycol, the diglycidyl ether of cyclohexane dimethanol, the diglycidyl ether of polyoxypropylene glycol, and the polyglycidyl ether of castor oil.

9. The flexible electrically-conductive epoxy adhesive composition of claim 1 further comprising at least one component selected from the group consisting of a nonreactive flexibilizer and a diluent, wherein said non-reactive flexibilizer is selected from the group consisting of polyols with molecular weights of at least 1,000 and triols with molecular weights ranging from about 1,500 to 6,000 and said diluent is selected from the group consisting of monoepoxides and secondary amines.

10. A flexible electrically-conductive epoxy adhesive composition comprising a combination of the following components:

(a) a polymer mixture comprising (I) at least one flexible polyepoxide resin selected from the group consisting of the adduct of two moles of bis-phenol-A with one mole of linoleic dimer acid, the trifunctional novolac epoxy of cardanol, the difunctional epoxy of cardanol, the diglycidyl ether of polyoxypropyleneglycol, the diepoxide of a polyoxypropylene diol, and the polyglycidyl ether of an aliphatic polyol, and (ii) a substantially stoichiometric amount of at least one latent epoxy resin curing agent, said at least one latent epoxy resin curing agent selected from the group consisting of aliphatic dihydrazide, adipic acid dihydrazide, icosanedioic acid dihydrazide, 7, 11 -octadecadiene-1,18-dicarboxylic acid dihydrazide, and valine dihydrazide, said aliphatic dihydrazide and said adipic acid dihydrazide optionally further comprising an accelerator;

(b) an electrically-conductive filler comprising a noble metal selected from the group consisting of silver, gold, and platinum and being present in the amount of at least about 40 volume percent of said composition;

(c) a non-reactive flexibilizer selected from the group consisting of polyols with molecular weights of at least 1,000 and triols with molecular weights ranging from 1,500 to 6,000; and (d) a diluent selected from the group consisting of monoepoxides and secondary amines, wherein said combination is theologically stable at room temperature and may be cured at a temperature ranging from about 100° C. to 140° C. in less than two hours to form said flexible electrically-conductive epoxy adhesive composition, said flexible electrically-conductive epoxy adhesive composition having a Durometer Shore A of less than 95 and a volume resistivity less than $10^{-2}$ ohm-cm at room temperature.

11. The method of claim 2 wherein said liquid components further comprise at least one secondary epoxy resin selected from the group consisting of the diglycidyl ether of 1,4-butanediol, the diglycidyl ether of neopentyl glycol, the diglycidyl ether of cyclohexane dimethanol, the diglycidyl ether of polyoxypropylene glycol, and the polyglycidyl ether of castor oil.

12. The method of claim 2 wherein said mixing of liquid and solid components is accomplished by milling said solid components into said liquid components.

* * * * *